US005450105A

United States Patent [19]

Dangelo

[11] Patent Number: 5,450,105

[45] Date of Patent: Sep. 12, 1995

[54] MANUAL PEN SELECTION FOR CLEARING NOZZLES WITHOUT REMOVAL FROM PEN CARRIAGE

[75] Inventor: Michael T. Dangelo, San Diego, Calif.

[73] Assignee: Hewlett-Packard Company, Palo Alto, Calif.

[21] Appl. No.: 56,326

[22] Filed: Apr. 30, 1993

[51] Int. Cl.[6] ..... B41J 2/165

[52] U.S. Cl. ..... 347/30

[58] Field of Search ..... 346/140 R; 347/24, 29, 347/30, 32

[56] References Cited

U.S. PATENT DOCUMENTS 4,853,717 8/1989 Harmon et al. ..... 346/140 R

FOREIGN PATENT DOCUMENTS 58-194568 11/1983 Japan .
59-78858 5/1984 Japan .
63-224957 9/1988 Japan ..... 347/30

*Primary Examiner*—Benjamin R. Fuller
*Assistant Examiner*—Alrick Bobb

[57] ABSTRACT

A thermal ink jet printhead cartridge priming apparatus that includes a plurality of caps respectively associated with a plurality of printhead nozzle arrays for controllably sealing printhead nozzle arrays pursuant to engagement thereof against the printhead cartridge to surround the nozzle arrays, a plurality of vacuum conveying elements respectively associated with the caps for individually conveying priming vacuum to an associated cap, a manually actuated selector assembly for connecting a selected one of the vacuum conveying elements to a source of priming vacuum, and a source of priming vacuum spaced apart from the manually actuated selector assembly for selectively engaging the selector assembly for application of vacuum thereto. By separating the vacuum source from the selector, positive pressure is not applied to the nozzle arrays when the caps are brought into engagement with the printhead cartridges since venting is provided by the unobstructed vacuum conveying elements.

8 Claims, 7 Drawing Sheets

FIG. 7
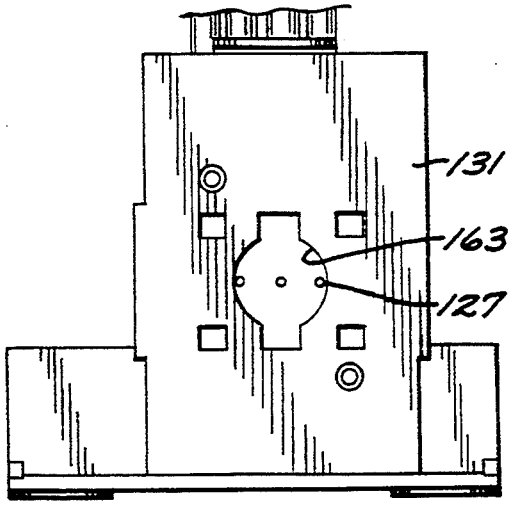
FIG. 8
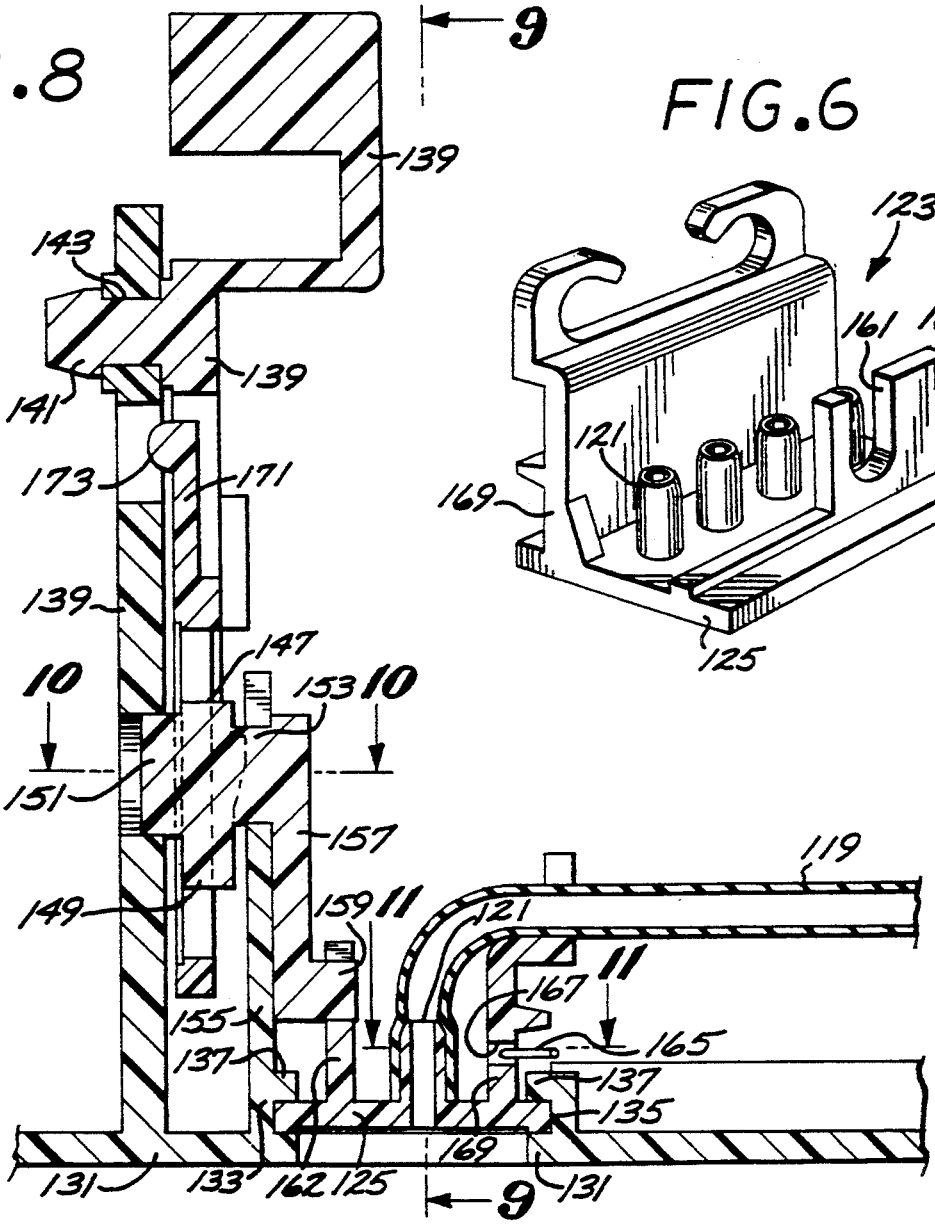
FIG. 6

MANUAL PEN SELECTION FOR CLEARING NOZZLES WITHOUT REMOVAL FROM PEN CARRIAGE

BACKGROUND OF THE INVENTION

The subject invention generally relates to ink-jet printer technology, and is directed more particularly to apparatus for priming a thermal ink jet printhead cartridge without removal of the printhead cartridge from the printer carriage.

Thermal ink jet printers commonly utilize printhead cartridges, often called pens, which typically include one or more ink reservoirs and an integrated circuit printhead that includes a nozzle plate having an array of ink ejecting nozzles which emit ink droplets in response to electrical pulses provided to the printhead.

An important consideration with thermal ink jet printhead cartridges is the need to ready a printhead for printing. For example, when a new printhead cartridge is installed in a printer or after a period of non-usage, the cartridge might be unable to produce ink drops at one or more nozzles, for example as a result of foreign contamination of the nozzles, dried ink in the nozzles, or air ingested into the nozzles.

Known systems for priming include those which involve the application of pressure to the ink supply in order to cause ink flow into the ink containing chambers that are adjacent the ink ejecting nozzles. Considerations with such known systems is need for access to the ink reservoir, and the various mechanical impedances between the ink reservoir and the nozzles which reduce the pressure that eventually reaches the nozzles.

Another known system requires that a printhead cartridge be removed from the printer carriage and inserted into a separate priming station for priming, which further requires that the printhead cartridge be removed from the priming station after priming and inserted back into the carriage. Considerations with these systems include the additional wear and tear on the electrical contacts of the printhead cartridge and the printer carriage, as well as the inconvenience of having to perform the remove and insert procedure two times for one priming.

A further known system includes a movable cap that is engageable with a printhead nozzle array and is directly connected to a tube of a peristaltic pump. Considerations with this system, however, include the need for separate pump for each printhead of a multiple printhead carriage, and clogging of the pump tube with ink.

SUMMARY OF THE INVENTION

It would therefore be an advantage to provide an improved ink jet printhead cartridge primer which provides for priming of a printhead cartridge nozzle array without removal of the printhead cartridge from the printer, avoids application of positive pressure to the printhead nozzle array, avoids clogging of vacuum conveying elements, and allows the use of a single vacuum source for priming each of a plurality of printhead of printhead cartridges of a multiple printhead printer.

The foregoing and other advantages are provided by the invention in a thermal ink jet printhead cartridge priming apparatus that includes a plurality of caps respectively associated with a plurality of printhead nozzle arrays for controllably sealing printhead nozzle arrays pursuant to engagement thereof against the printhead cartridge to surround the nozzle arrays, a plurality of vacuum conveying elements respectively associated with the caps for individually conveying priming vacuum to an associated cap, a manually actuated selector assembly for connecting a selected one of the vacuum conveying elements to a source of priming vacuum, and a source of priming vacuum spaced apart from the manually actuated selection means for selectively engaging the selector assembly for application of vacuum thereto. By separating the vacuum source from the selector, positive pressure is not applied to the nozzle arrays when the caps are brought into engagement with the printhead cartridges since venting is provided by the unobstructed vacuum conveying elements.

BRIEF DESCRIPTION OF THE DRAWINGS

The advantages and features of the disclosed invention will readily be appreciated by persons skilled in the art from the following detailed description when read in conjunction with the drawing wherein:

FIG. 6 is a schematic perspective view of a slider of the selector assembly of the priming apparatus of the invention.

FIG. 7 is a schematic bottom plan view of the selector assembly of the priming apparatus of the invention.

FIG. 8 is a schematic side elevational sectional view of the selector assembly of the priming apparatus of the invention.

DETAILED DESCRIPTION OF THE DISCLOSURE

Figure 1:
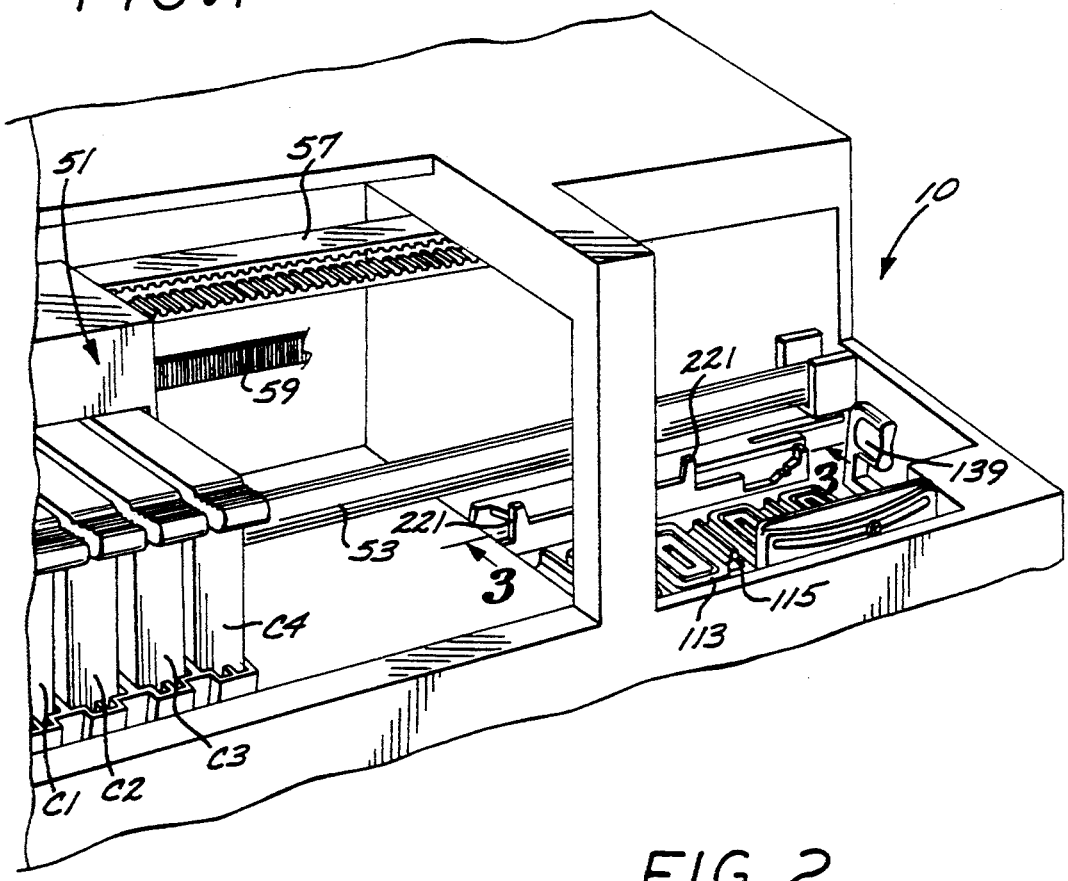
FIG. 1 is a schematic perspective view of the major mechanical components of a thermal ink jet printer that includes primer apparatus in accordance with the invention.
Figure 2:
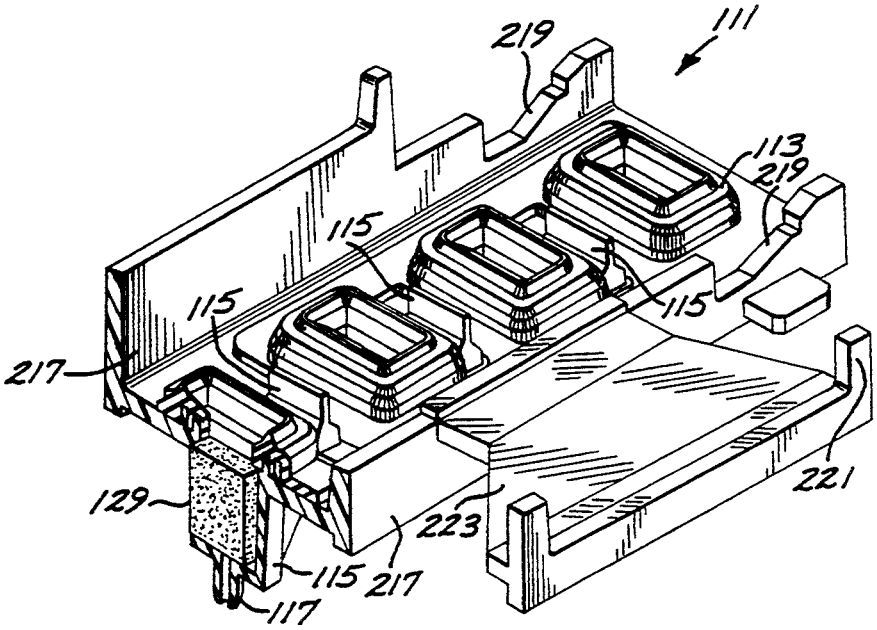
FIG. 2 is a schematic perspective view of the service station sled of the printer of FIG. 1.

In the following detailed description and in the several figures of the drawing, like elements are identified with like reference numerals.

Referring now to FIG. 1, set forth therein is a schematic frontal quarter perspective view depicting, by way of illustrative example, major mechanical components of a multiple printhead ink jet printer in which the techniques of the invention can be implemented. The printer includes a movable carriage 51 mounted on a guide rail 53 for translational movement along the carriage scan axis (commonly called the Y-axis in the printer art). The carriage 51 is driven along the guide rail 53 by an endless belt 57 which can be driven in a conventional manner, and a linear encoder strip 59 is utilized to detect position of the carriage 51 along the carriage scan axis, for example in accordance with conventional techniques.

The carriage 51 removably retains four printhead cartridges C1, C2, C3, C4 (sometimes called "pens," "print cartridges," or "cartridges") which are side by side along the carriage axis. Each of the cartridges C1, C2, C3, C4 includes a nozzle array comprised of a plurality of downwardly facing nozzle arrays for ejecting ink generally downwardly to a print media which is supported in an appropriate manner below the path traversed by printhead cartridges when the carriage 51 is scanned along the carriage axis. The print media is moved along a print media axis which is orthogonal to the carriage scan axis. In accordance with conventional thermal ink jet printhead architecture, ink drops are fired from the nozzles pursuant to ink firing pulses applied to heater resistors respectively associated with the nozzles and located in the printhead interiorly of the nozzles.

By way of illustrative example, the cartridges C1, C2, C3 comprise non-black color printing cartridges for producing the base colors of yellow, cyan, and magenta as commonly utilized in color printing, while the cartridge C4 comprises a black printing cartridge.

The printer of FIG. 1 further includes a service station located to one side of the media print area and generally indicated by the reference numeral 10. The service station functions to cap the nozzle arrays of the printhead cartridges, and wipe the nozzle arrays. The station more particularly includes a movable sled 111 that includes respective caps 113 configured to cap respective nozzle arrays of the cartridges when the carriage is moved into position over the caps 113. In particular, the caps 113 are designed to surround the printhead nozzle arrays rather than contact them, so as to reduce drying of ink. The caps 113 further function to convey priming vacuum to the nozzle arrays of the printhead cartridges. The movable sled 111 also includes resilient wipers 115 for wiping the nozzle arrays of the printhead cartridges as described more fully herein.

The movable sled 111 further includes vertical side panels 217 in front of and behind the caps 113, and cam surfaces 219 are formed in the side panels generally adjacent the distal caps. The cam surfaces 219 are mirror images of each other across a vertical plane that is parallel to the carriage axis. The sled also includes two vertically extending cam follower prongs 221 that formed on the front side panel between the cam surfaces 119, and two vertically extending cam follower prongs 221 on a forwardly extending panel 223. The cam following prongs 221 are mirror images of each other across a vertical plane that is parallel to the carriage axis. As shown more fully in FIGS. 12–17, vertical and horizontal movement of the sled 111 is controlled by engagement of the vertical prongs 221 by cam surfaces 233 and slots 231 in the carriage 51 and by the upward engagement of the cam surfaces 219 against stationary guide pegs 237 pursuant to upwardly biasing springs 235. In particular, the cam surfaces 219 and the vertical prongs 221 of the sled, stationary guide pegs 237 engaged with the cam surfaces 219, and the cam surfaces 233 and slots 231 of the carriage 51 that engage the vertical prongs 221 are configured such that the sled 111 is in its vertically highest position, called the capping position, when it is furthest from the print media (i.e., towards the right side of the printer), and is in its vertically lowest position, called the down position, when it is closest to the print media region (i.e., towards the center of the printer). In the capped position, the caps 113 of the sled 111 are in engagement with the nozzle arrays of the printhead cartridges, while in the down position the caps 113 and the wipers 115 are away from the path of the nozzle arrays. The carriage 51 and the sled 111 are configured such that wiping only takes place when the carriage moves to left after positioning the sled in the capping position pursuant to movement of the carriage to the right.

Figure 3:
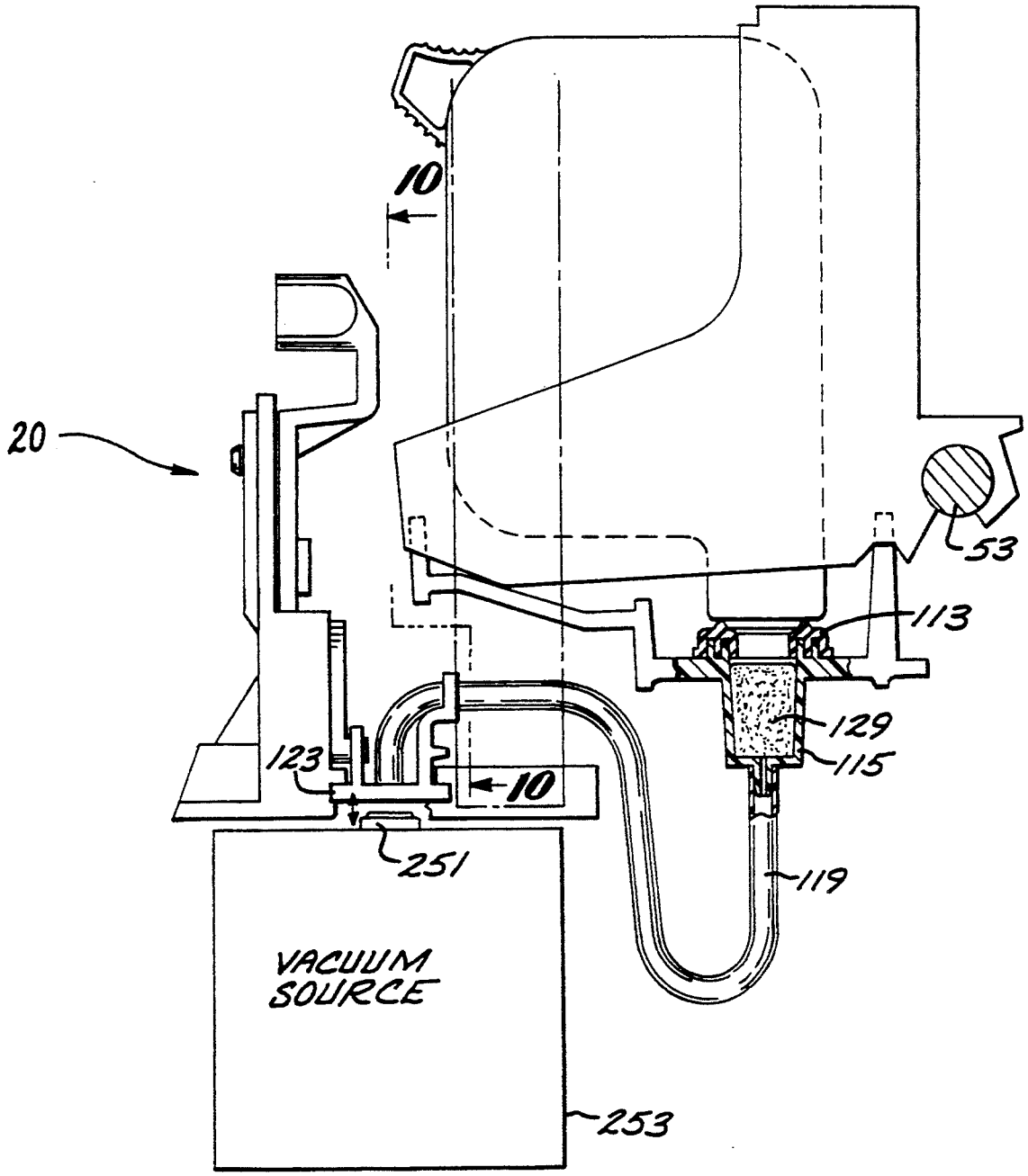
FIG. 3 is a schematic elevational partial sectional view showing connections between nozzle array sealing caps on the station sled and the selector assembly of the priming apparatus of the invention.

As shown in FIG. 3 for one of the caps 113, each cap 113 is secured to the top opening of a chamber 115 that extends downwardly and includes a lower port 117 that is connected to one end of a flexible tube 119 whose other end is connected to a corresponding fitting 121 of a slider 123 which includes a base 125 on which the fittings 121 are located. Respective bores 127 extend from the bottom of the base 125 through the top ends of the fittings 121. The slider 123 is part of a selector assembly, generally indicated by the reference numeral 20, that is located at the front of the service station to enable operator selection of the capped nozzle array that is to receive priming vacuum via a corresponding cap 113 engaged therewith. Each chamber 115 of the movable sled 111 can contain a filter 129 for trapping ink to prevent ink from entering and clogging the flexible tube 119. It should be appreciated that most of the ink that emerges from the nozzles pursuant to priming remains on the nozzle plate and is removed by the wipers 115 when the carriage 51 leaves the service station.

Figure 4:
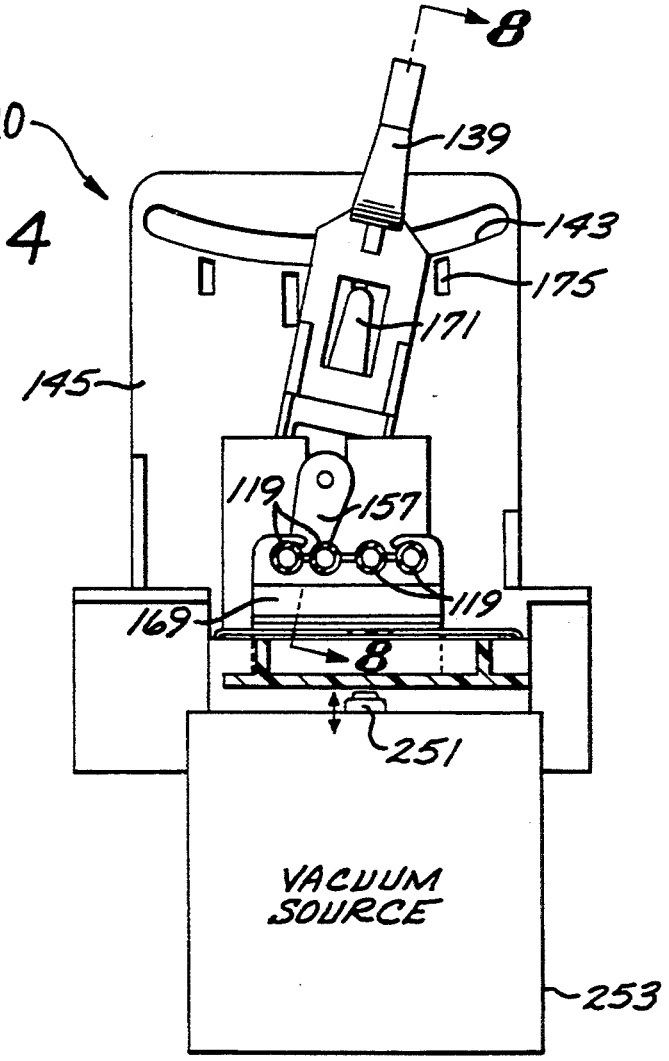
FIG. 4 is a schematic rear elevational view of the selector assembly of the priming apparatus of the invention.
Figure 5:
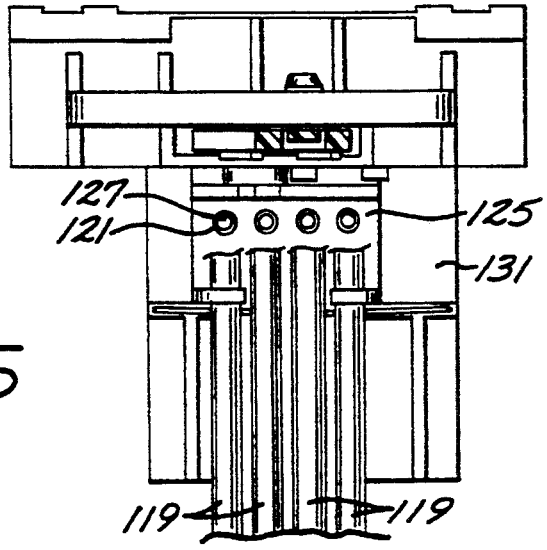
FIG. 5 is a schematic top plan view of a slider of the selector assembly of the priming apparatus of the invention.
Figure 9:
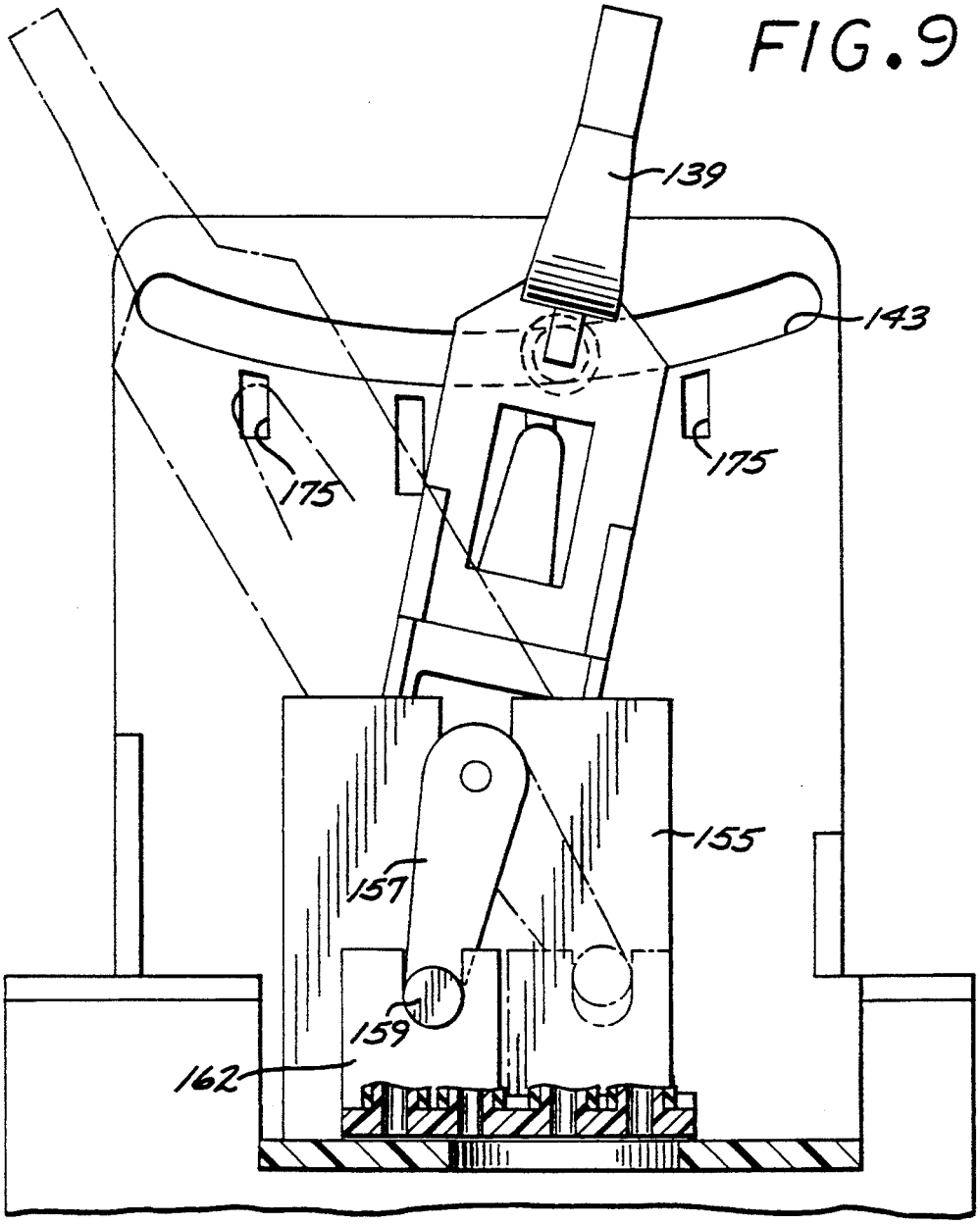
FIG. 9 is a schematic rear elevational view illustrating the operation of the selector assembly of the priming apparatus of the invention.
Figure 10:
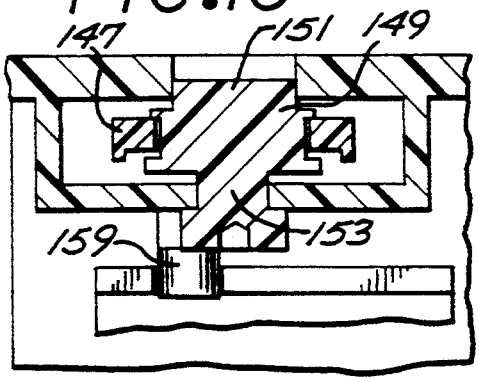
FIG. 10 is a schematic top plan sectional view illustrating the engagement between a selector lever and a rotatable slider block of the of the selector assembly of the priming apparatus of the invention.
Figure 11:
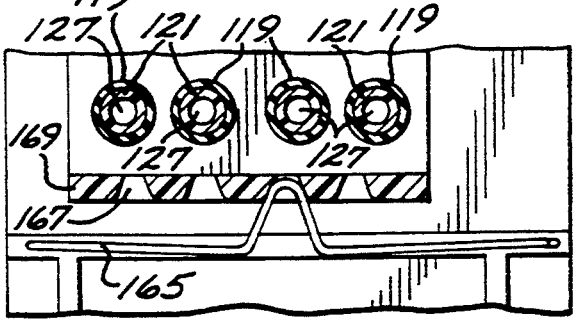
FIG. 11 is a schematic top plan sectional view illustrating a detent mechanism for locating the slider of the selector assembly of the priming apparatus of the invention.

As shown generally in FIGS. 4 and 5, the selector assembly includes a selector lever 139 that is linked to the slider 123 to cause the slider to move along a linear path that is parallel to the carriage axis. The fittings 121 are arranged linearly parallel to the carriage axis, and the slider is selectively positionable by means of detents at predetermined positions along its travel path at which a respective fitting is aligned with a vacuum cap 251 of a vacuum source 253. Pursuant to appropriate actuation, the vacuum source cap 251 travels upwardly through an opening 163 in a horizontal panel of the selector assembly 20 to briefly engage the bottom surface of the slider while negative pressure is at the opening of the vacuum source cap 251. Such negative pressure is transmitted to the printhead cartridge that is capped by the cap that is connected to the slider bore aligned with the vacuum source cap 251 at the time the vacuum source is actuated. By separating the vacuum source cap 251 from the bores of the slider, positive pressure is not applied to the nozzle arrays when the caps are brought into engagement with the printhead cartridges since venting is provided by the unobstructed bores in the slider. In other words, positive pressure is prevented by providing a vent path between the caps and the lower ends of the bores in the slider.

Referring more particularly to FIGS. 8–11, the slider 125 more particularly travels along the carriage axis in a guideway comprised of the top surface of the horizontal panel 131 of the selector assembly, two vertical walls 133, 135 disposed on the horizontal panel 131, and guide tabs 137 extending inwardly from the vertical walls. The slider 125 is moved by operator actuation of the lever 139 that includes a guide peg 141 attached thereto and slidably captured in an arcuate slot 143 formed in a vertical panel 145 that is attached to the horizontal panel 131. The lever 139 includes parallel arms 147 which extend downwardly relative to the guide peg 141 and are slidably engaged with a slide block 149 that is rotatably secured between the vertical panel 145 and a vertical wall 155 that is adjacent the vertical panel 145. In particular, the slide block 149 includes co-axial pins 151, 153 that are rotatably secured in openings in the vertical panel 145 and the vertical wall 155. A crank 157 extends from the pin 153 on the side of the vertical wall 155 that is away from the slide block 149 and is parallel to the parallel arms of the lever 139 when such parallel arms are engaged with the slide block 149. A pin 159 is located at the end of the crank away from the pin 153 and is slidably engaged in a slot 161 formed in a vertical wall 162 located adjacent the edge of the slider base 123 that is adjacent the vertical wall 155. Pursuant to the foregoing structure, movement of the selector lever 139 causes the slider block to rotate as the parallel arms 147 rotate and slide relative the slider block 149. Rotation of the slider block 149 causes the crank 157 to pivot such that the pin 159 moves in an arc. The arcuate motion of the pin 159 causes the slider 123 to move linearly since it is constrained to move only linearly and since the crank pin 159 slides up and down in the slot 161 as the horizontal component of its motion is transmitted to the slider 123.

As described earlier, a purpose of the selector assembly is to selectively position the slider 123 such that a selected bore 127 is aligned with the vacuum applying cap 251 that is located below the slider and which is controllably engaged against the bottom of the slider base through the opening 163 in a horizontal panel 131 of the selector assembly 20. In that regard, primary detent slots 167 are provided in a short vertical wall 169 located on the slider base 123 inboard of the guide tabs 137. The detent slots 167 are engaged by a V-shaped section of a wire detent spring 165 which includes ends that are located in holes at the ends of the vertical wall 135. The detent slots 167 and the V-shaped section of the detent spring 165 are configured such that engagement of the detent spring in a detent slot positions the slider with a corresponding slider bore 127 aligned with the vacuum cap 251. For tactile feedback in regard to the detent positioning of the slider 123, the selector lever 139 includes a detent arm 171 that extends upwardly from the parallel arms 147 and includes a detent bump 173 at an end thereof that is below the arcuate slot 143. The vertical panel 145 includes four auxiliary detent slots 175 that are located such that each detent slot secures the selector lever 139 at an angular position at which the slider is in a corresponding detent position with a corresponding slider bore 127 aligned with the vacuum cap 251.

In the foregoing selector assembly, by virtue of the arcuate slot 143 and the sliding engagement of the selector lever parallel arms 147 with the slider block 149, the top end of selector lever 139 tends to remain at approximately the same elevation while it changes angle pursuant to movement of the lever end generally along the carriage axis. Further, by virtue of the crank 157, the slider moves oppositely from the direction in which the end of the selector lever 139 is moved. Both of these factors provide for correlation of the selector lever position with the bore aligned with the vacuum source cap 251. For example, positioning the lever 139 to the left most detent position locates the slider to the rightmost position such that the leftmost slider bore is in alignment with the vacuum source cap 251. Lever position is further correlated with selection of a capped printhead cartridge for receiving priming vacuum by connecting each sled fitting 121 to the sled chamber that is correspondingly located along the carriage axis. In this manner, when the carriage 51 is in the capping position, the position of the selector lever 139 correlates with the printhead cartridge that can receive priming vacuum, such that a printhead cartridge is selected for priming by positioning the selector lever 139 at the position that corresponds to the position of the printhead cartridge on the carriage.

The priming vacuum source 30 can comprise a manually actuated vacuum generating primer as disclosed in commonly assigned copending U.S. application Ser. No. 08/056,012, filed Apr. 30, 1993, by K. L. Glassett and S. W. Bauer for "IN-LINE/OFF-LINE PRIMER FOR INK JET CARTRIDGE," incorporated herein by reference. Generally, the vacuum source 253 is selectively actuated to cause the vacuum source cap 251 to briefly engage the bottom surface of the slider base 125 while negative pressure is at the opening of the vacuum source cap 251, for example pursuant to manual actuation of a plunger. Such negative pressure is transmitted to the printhead cartridge that is capped by the cap that is connected to the slider bore aligned with the vacuum source cap 251 at the time the vacuum source is actuated.

Figure 12:
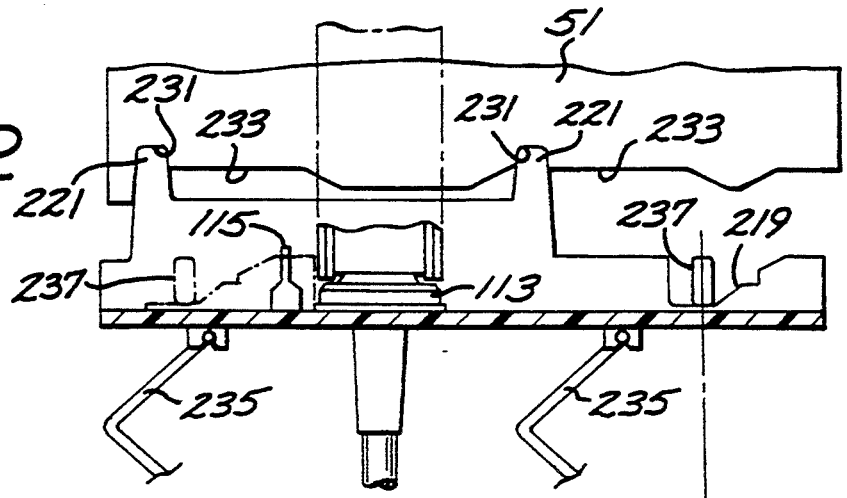
FIG. 12 is a schematic elevational view illustrating the sled of the printer of FIG. 1 in a capping position with printhead nozzle arrays capped by caps on the sled.
Figure 13:
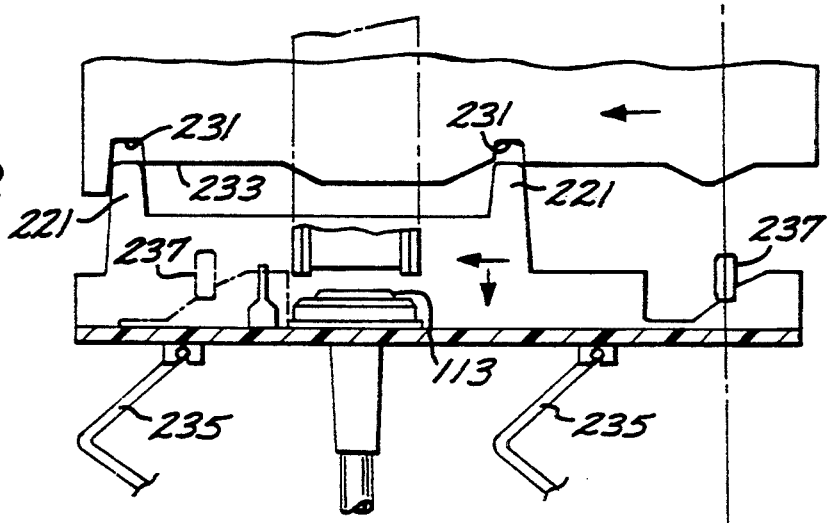
FIG. 13 is a schematic elevational view illustrating the sled of the printer of FIG. 1 as it is moved from the capping position by movement away from the capping location of the carriage that supports the printhead nozzle arrays.
Figure 14:
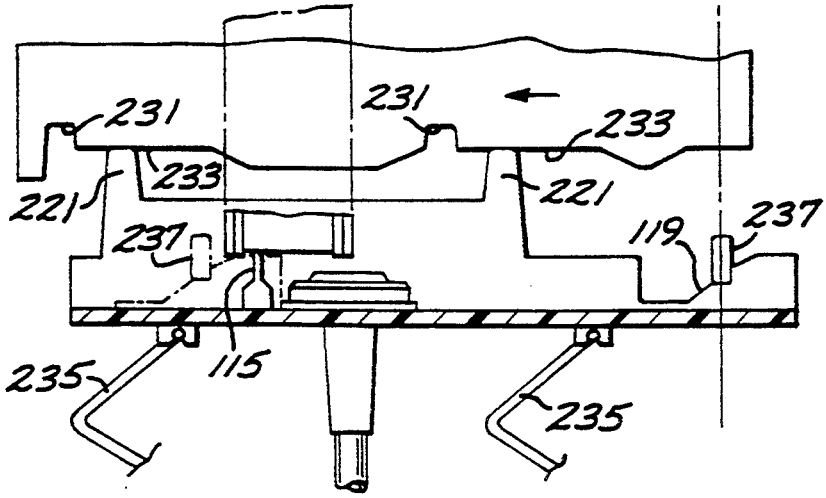
FIG. 14 is a schematic elevational view illustrating the sled of the printer of FIG. 1 in a stationary wiping position wherein printhead nozzle arrays move against wipers on the sled as the carriage continues to move away from the capping location.
Figure 15:
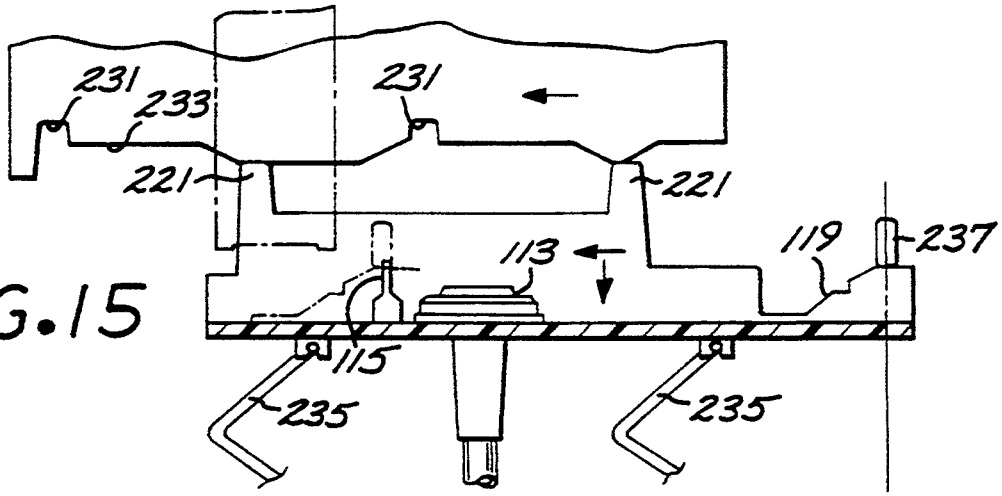
FIG. 15 is a schematic elevational view illustrating the sled of the printer of FIG. 1 as it is moved from the wiping position to the down position as the carriage continues to move away from the capping location after the printhead nozzle arrays have been wiped.
Figure 16:
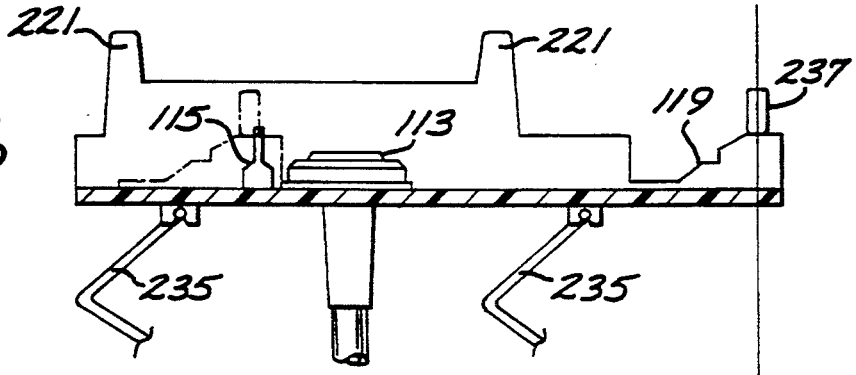
FIG. 16 is a schematic elevational view illustrating the sled of the printer of FIG. 1 in a stationary down position to which it has been moved pursuant to the continued movement of the carriage away from the capping location.
Figure 17:
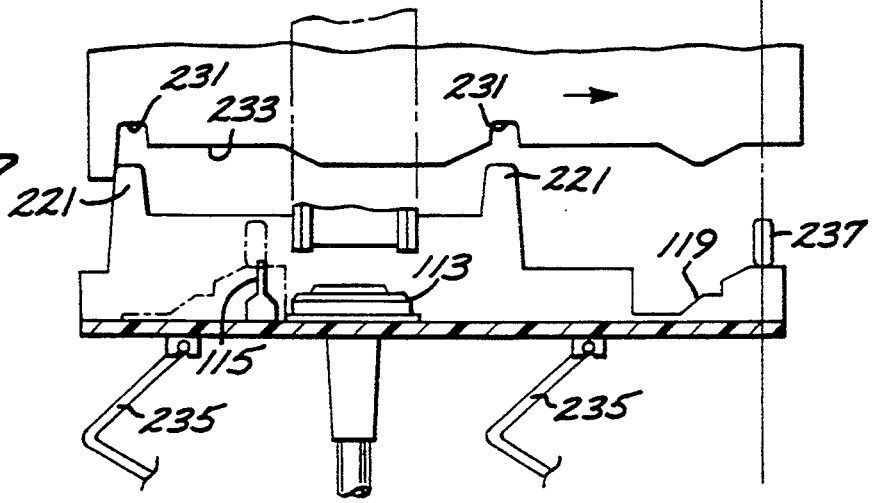
FIG. 17 is a schematic elevational view illustrating the sled of the printer of FIG. 1 as it is engaged by the carriage as the carriage moves toward the capping location.

Referring now to FIGS. 12–17, the sled 111 and the carriage 51 cooperate as follows to cap the nozzle arrays of the printhead cartridges and to wipe the nozzle arrays when the carriage moves away from engagement of the sled in the capped position. As shown in FIG. 12, when the sled is in the capping position, it is in its vertically highest position such that the caps 113 are in engagement with the printhead nozzle arrays that are overlying the caps as a result of movement of the carriage to the right to position the sled in the capping position. In the capping position, the prongs 221 of the sled are engaged in slots 231 of the carriage, and the lowest portion of the cam surfaces 219 are engaged against the stationary pegs 237 pursuant to the upward bias of the sled by the springs 235. As the carriage is moved to the left toward the center of the printer, the sled is moved to the left by virtue of the prongs 221 being contained in the slots 231 of the carriage. As the sled is moved to the left, it is vertically lowered away from the printhead cartridges as sloped portions of the cam surfaces 219 slide across the stationary pegs 237. Notches in the cam surfaces eventually engage the stationary pegs, at which time the sled prongs 221 are clear of slots 231 in the carriage 51. As the carriage continues its movement to the left, the prongs 221 remain clear of the cam surfaces 233 of the carriage 51, and sled remains stationary while the nozzle arrays of the printhead cartridges slide over the resilient wipers 115. Continued movement of the carriage causes bumps in the cam surfaces 233 of the carriage 51 to engage the prongs 221 which causes the sled to move downward and to the left as the notches in the sled cam surfaces 219 disengage from the stationary pegs 237 sloped portions of the sled cam surfaces slide against the stationary pegs. The downward and to the left movement of the sled continues until horizontal portions of the sled cam surfaces become engaged with the stationary pegs 237 at which time the prongs 221 are clear of the bumps in the carriage cam surfaces 233. The sled is then in its down position wherein the upper edges of the wipers are vertically lower than the printhead nozzle arrays.

The sled is moved to the capping position pursuant to engagement of the prongs 221 by the carriage slots 231 as the carriage moves to the right. Since the sled is in the down position, the printhead nozzle arrays remain higher than the wipers until the carriage slots engage the prongs 221, at which time the printhead nozzle arrays are positioned over the caps 113. Continued movement of the carriage to the right causes the sled to move up and to the right with the carriage as the sled cam surfaces 219 slide across the stationary pegs 237. Eventually, the caps come into engagement with the printhead nozzle arrays, with the alignment between the nozzle arrays and the caps being controlled by the relative positioning of the slots 231 of the carriage and the prongs 221 of the sled 111.

More specific information as to the operation of the sled 111 relative to the carriage 51 is more particularly described in commonly assigned copending U.S. application Ser. No. 08/056,327, filed Apr. 30, 1993, by Heinz Waschhauser and William Osborne for "SERVICE STATION HAVING REDUCED NOISE, INCREASED EASE OF ASSEMBLY AND VARIABLE WIPING CAPABILITY," which is incorporated herein by reference; and in commonly assigned copending U.S. application Ser. No. 07/949,197, filed Sep. 21, 1992, by William S. Osborne for "INK-JET PRINTHEAD CAPPING AND WIPING METHOD AND APPARATUS," which also incorporated herein by reference.

Although the foregoing has been a description and illustration of specific embodiments of the invention, various modifications and changes thereto can be made by persons skilled in the art without departing from the scope and spirit of the invention as defined by the following claims.

What is claimed is:

1. Primer apparatus for priming one of a plurality of printhead cartridges supported by a print carriage that is movable along a carriage scan axis, wherein each of the printhead cartridges includes a printhead nozzle array comprised of ink ejecting nozzles such that the printhead cartridges include respective printhead nozzle arrays, and wherein the printhead cartridges are arranged in a predetermined arrangement, comprising:

a movable sled having a plurality of caps respectively associated with the printhead nozzle arrays for sealing said printhead nozzle arrays when the carriage is moved along the carriage axis to a position adjacent said sled, said caps being moved into engagement with the printhead cartridges to surround the printhead nozzle arrays pursuant to the movement of said sled towards said printhead nozzle arrays;

a plurality of vacuum conveying means respectively associated with said caps for individually conveying priming vacuum to respective caps;

a source of priming vacuum having a vacuum conveying cap;

manually actuated selection means for selecting a selected one of said vacuum conveying means to receive priming vacuum from said source of priming vacuum; and means for moving said vacuum conveying cap of said source of priming vacuum such that said vacuum conveying cap is engaged with said selection means for application of vacuum to said selected one of said vacuum conveying means, and said vacuum conveying cap is disengaged from said selection means when priming vacuum is not being applied to any of said vacuum conveying means, whereby positive pressure is not produced when said respective caps are brought into engagement with respective printhead cartridges.

2. The primer apparatus of claim 1 wherein each of said plurality of vacuum conveying means includes:

a chamber for supporting a respective one of said caps at a cap opening;

filtering means contained within said chamber for trapping ink; and a flexible tube connected between said chamber and said manually actuated selection means, such that said plurality of vacuum conveying means includes a plurality of chambers for supporting respective caps, a plurality of filtering means contained within respective chambers, and a plurality of flexible tubes connected between respective chambers and said manually actuated selection means.

3. The primer apparatus of claim 2 wherein said selection means includes:

a slider for receiving the flexible tubes connected to the chambers of the vacuum conveying means, said slider include a plurality of bores in respective communication with said flexible tubes; and lever means for controlling the position of said slider such that vacuum from said vacuum source is applied to a selected one of said bores.

4. The primer apparatus of claim 3 further including detent means for controlling the position of said slider.

5. Primer apparatus for priming one of a plurality of printhead cartridges supported by a print carriage that is movable along a carriage scan axis, wherein each of the printhead cartridges includes a nozzle array comprised of ink ejecting nozzles such that the printhead cartridges includes respective printhead nozzle arrays, and wherein the printhead cartridges are arranged in a predetermined arrangement, comprising:

a plurality of caps respectively associated with the printhead nozzle arrays for controllably sealing said printhead nozzle arrays pursuant to engagement of said caps with respective printhead cartridges to surround the nozzle arrays;

a plurality of vacuum conveying means respectively associated with said caps for individually conveying priming vacuum to an associated one of said caps;

a source of priming vacuum having a vacuum conveying cap; and manually actuated selection means for selecting a selected one of said vacuum conveying means to receive priming vacuum from said vacuum conveying cap of said source of priming vacuum;

means for moving said vacuum conveying cap of said source of priming vacuum such that said vacuum conveying cap is engaged with said selection means for application of vacuum to said selected one of said vacuum conveying means, and said vacuum conveying cap is disengaged from said selection means when priming vacuum is not being applied to any of said vacuum conveying means, whereby positive pressure is not produced when said respective caps are brought into engagement with respective printhead cartridges.

6. The primer apparatus of claim 5 wherein each of said plurality of vacuum conveying means includes:

a chamber for supporting a respective one of said caps at a cap opening;

filtering means contained within said chamber for trapping ink; and a flexible tube connected between said chamber and said manually actuated selection means, such that said plurality vacuum conveying means includes a plurality of chambers for supporting respective caps, a plurality of filtering means contained within respective chambers, and a plurality of flexible tubes connected between respective chambers and said manually actuated selection means.

7. The primer apparatus of claim 6 wherein said selection means includes:

a slider for receiving the flexible tubes connected to the chambers of the vacuum conveying means, said slider include a plurality of bores in respective communication with said flexible tubes; and lever means for controlling the position of said slider such that vacuum from said vacuum source is applied to a selected one of said bores.

8. The primer apparatus of claim 7 further including detent means for controlling the position of said slider.

* * * * *